United States Patent [19]

Minnick

[11] 4,257,356

[45] Mar. 24, 1981

[54] HEAT EXCHANGING APPARATUS AND METHOD

[75] Inventor: Lawrence E. Minnick, Los Altos Hills, Calif.

[73] Assignee: Electric Power Research Institute, Palo Alto, Calif.

[21] Appl. No.: 917,803

[22] Filed: Jun. 22, 1978

[51] Int. Cl.[2] ..... F22B 1/04

[52] U.S. Cl. ..... 122/32; 165/134 R; 165/154; 165/155; 176/65

[58] Field of Search ..... 165/134, 154, 155; 122/32, 34; 176/65

[56] References Cited

U.S. PATENT DOCUMENTS

| | | | |
|---|---|---|---|
| 1,644,841 | 10/1927 | Lupfer | 165/66 |
| 2,653,013 | 9/1953 | Freer | 257/241 |
| 3,029,796 | 4/1962 | Simmons et al. | 122/32 |
| 3,287,229 | 11/1966 | Peter | 176/65 |
| 3,374,149 | 3/1968 | Parris | 176/65 |
| 3,521,703 | 7/1970 | Koziarr | 165/66 |
| 3,557,760 | 1/1971 | Romanos et al. | 122/32 |
| 3,568,781 | 3/1971 | Campbell et al. | 176/65 |
| 3,613,781 | 10/1971 | Barratt | 122/32 |
| 3,726,339 | 4/1973 | Ash | 165/134 |
| 3,853,482 | 12/1974 | Bhan | 165/134 |
| 3,868,994 | 3/1975 | Petrek | 122/34 |
| 4,029,055 | 6/1977 | Haese | 165/135 |

OTHER PUBLICATIONS

Vendryes, George A., Superphenix: A Full-Scale Breeder Reactor, *Scientific American,* Mar. 1977, pp. 26-34.

*Primary Examiner*—Edward G. Favors
*Attorney, Agent, or Firm*—Flehr, Hohbach, Test

[57] ABSTRACT

A heat exchanging apparatus for reducing the temperature of a heating fluid prior to thermal communication with a heated fluid. The apparatus includes an integral pre-cooling heat exchanger located within a main heat exchanger. The pre-cooling heat exchanger brings the heating fluid into thermal communication with the heating fluid circulating in the main heat exchanger so that the heated fluid is prevented from departing from nucleate boiling in the main heat exchanger.

9 Claims, 5 Drawing Figures

HEAT EXCHANGING APPARATUS AND METHOD

BACKGROUND OF THE INVENTION

1. Field of the Invention

The present invention generally relates to heat exchangers, and in particular, to steam generators used in nuclear reactors.

2. Description of the Prior Art

A heat exchanger is an apparatus used to transfer heat from a fluid flowing on one side of a barrier to another fluid or fluids flowing on the other side of a barrier. One of these fluids is designated the heating fluid and the other, the heated fluid.

In nuclear power plants the heat exchanger used to make steam is commonly called a steam generator. The nuclear reactor generates heat which is transferred to the steam generator by a flow of primary coolant. The primary coolant is the heating fluid and causes the water in the steam generator to form steam. The steam is typically used to drive turbines and generate electrical power.

Recently, research has been conducted in developing a fast breeder reactor for commercial electric power stations. The present state of this research is outlined in the article entitled "Superphenix: A Full-Scale Breeder Reactor," Scientific American, March 1977, Vol. 236, No. 3, pp. 26–35.

The primary coolant in a typical fast breeder reactor is sodium. At atmospheric pressure sodium is liquid at 90° Celsius and boils at 882° C. A fast breeder reactor generates heat which is transferred to an intermediate heat exchanger through a primary sodium flow circuit. The intermediate heat exchanger is in turn cooled by a secondary sodium circuit which transfers the heat from the fast breeder reactor to a steam generator to form steam. In normal operation a typical fast breeder reactor has a temperature of 395° C. at the inlet of the reactor and a temperature of 545° C. at the outlet.

Heretofore, one problem with operating at these high primary coolant temperatures has been avoiding severe thermal transients in the water-steam circuit of the steam generator. A fast breeder reactor has the potential for developing high heat flux, and if this heat flux is not carefully regulated, it can quickly overcome the heat transfer capability of the steam generator. Most steam generators today are designed to avoid departing from nucleate boiling (DNB) in the water tubes of the steam generator. When a departure from nucleate boiling occurs, the bulk temperature of the water exceeds its saturation temperature. Bubbles begin to form throughout the water in the steam generator and the rate of heat transfer from the primary coolant markedly decreases. The bubbles tend to block the flow of water through the water tubes and a blanket of steam envelopes the tubes. This phenomenon, called bulk boiling, substantially reduces the transfer of heat from the tube wall to the water in the steam generator. The wall temperature of the water tubes rapidly climbs and the steam generator experiences a rapid temperature excursion.

In a fast breeder reactor departure from nucleate boiling is an especially critical design problem because the temperature of the primary coolant is high. In turn, the average temperature of the water in the steam generator is closer to its saturation temperature. Thus, the thermal margin to DNB is smaller than in other reactor power plants.

Prior approaches to the problem of insuring that DNB does not occur have suggested positioning protective tubes around the water tubes. Another concept is the placement of internal turbulators within the water tubes to break up the blanket of steam that accompanies bulk boiling. In addition, the use of smaller diameter water tubes has been suggested along with increasing the rate of flow of water through the water tubes.

In general, these prior approaches all significantly increase the complexity of the design of a steam generator along with the cost of its fabrication and operation. In addition, these prior approaches increase the risk of malfunction and the possibility of leakage between the sodium and the water. Lastly, and more importantly, these prior designs do not totally insure that departure from nucleate boiling will not occur in the water tubes of the steam generator.

SUMMARY OF THE INVENTION

The primary object of the present invention is to overcome the limitations and disadvantages of the prior art.

A principal object of the present invention is to insure that a departure from nucleate boiling (DNB) does not occur in the water tubes of a nuclear reactor steam generator.

An additional object of the present invention is to permit operation of a nuclear power plant with a high primary system temperature while maintaining a substantially lower temperature in the steam-water system.

A further object of the present invention is to permit the generation of saturated steam in a liquid metal fast breeder reactor.

Another object of the present invention is to reduce the temperature of the primary coolant prior to thermal communication with the water in a steam generator without a substantial loss of heat for generating steam from water.

Still another object is to reduce the temperature of the sodium in contact with the shell and the upper tube sheet of the steam generator. Reduction of sodium temperature at the shell has the beneficial effect of reducing axial expansion of the casing relative to the colder tubes containing water. Reduction of sodium temperature at the upper tube sheet has the beneficial effect of reducing the degree of thermal shock on this very large and heavy device in the event of a reactor scram or other transient condition wherein the temperature of the heating fluid is rapidly decreased.

These and other objects are achieved by heat exchanging apparatus that reduces the temperature of the heating fluid prior to thermal communication with the heated fluid. The apparatus includes an integral precooling heat exchanger located within a main heat exchanger. The pre-cooling heat exchanger brings the heating fluid into thermal communication with the heating fluid circulating in the main heat exchanger before the heating fluid is circulated within the main heat exchanger. By reducing the temperature of the heating fluid in this manner, the heated fluid is prevented from departing from the nucleate boiling in the main heat exchanger.

Additional objects and features of the invention will appear from the following description in which the preferred embodiments have been set forth in detail in conjunction with the accompanying drawings.

DESCRIPTION OF THE PREFERRED EMBODIMENTS

FIGS. 1–4 illustrate a steam generator for producing saturated steam in a nuclear power plant. The steam generator is basically a shell-and-tube heat exchanger with a steam drum 9 located at its upper end. The shell 6 of the heat exchanger is formed by the vertical, cylindrical side wall of the generator. The tube bundle 7 of the heat exchanger comprises a plurality of vertical water tubes centrally located within the shell of the heat exchanger. The heating fluid is primary coolant from a nuclear reactor (not shown). In the preferred embodiment the primary coolant is molten sodium and the nuclear reactor is a fast breeder reactor. The heated fluid in the steam generator is water which is converted to steam.

Figure 1:
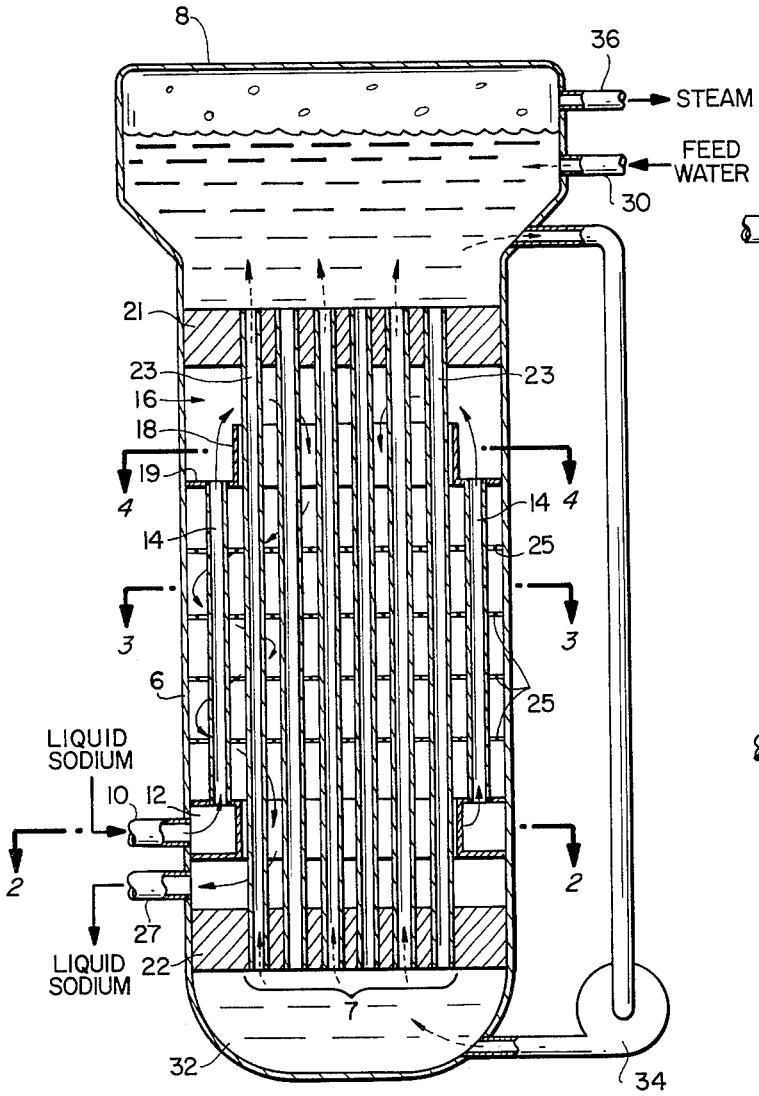
FIG. 1 is a side elevational view, partially cut away and in section, of a nuclear reactor steam generator according to the present invention.
Figure 2:
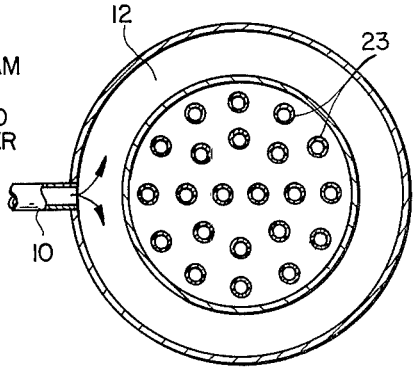
FIG. 2 is a top plan view, in section, taken along line 2—2 of the steam generator of FIG. 1.
Figure 3:
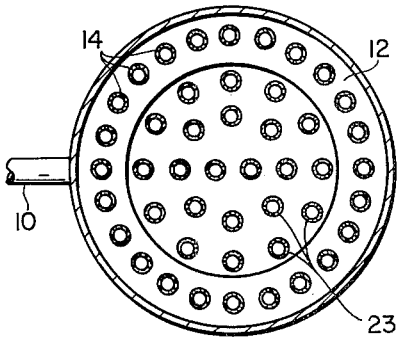
FIG. 3 is a top plan view, in section, taken along line 3—3 of the steam generator of FIG. 1.
Figure 4:
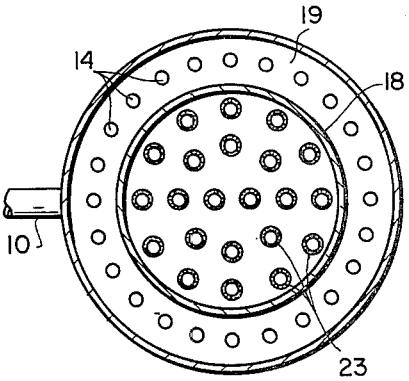
FIG. 4 is a top elevational view, in section, taken along line 4—4 of the steam generator of FIG. 1.
Figure 5:
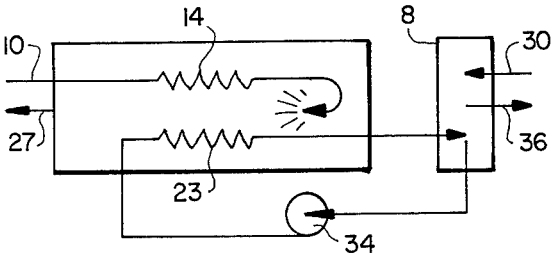
FIG. 5 is a schematic diagram of the steam generator of FIG. 1.

Referring to FIG. 1, liquid sodium enters the steam generator through an inlet 10. The sodium inlet is connected to the hot leg of a fast breeder reactor primary coolant loop (not shown). The liquid sodium passes through the inlet and enters a manifold 12 located on the inner side wall 6 of the steam generator. The manifold is generally rectangular in cross section and conforms to the cylindrical shape of the steam generator. The manifold distributes the liquid sodium evenly to a plurality of vertical spaced-apart conduits 14. These conduits are heat transfer tubes that are distributed around the periphery of the tube bundle 7. The heat transfer tubes are in thermal communication with the heating fluid flowing in the shell of the steam generator. It should be noted that the heat transfer tubes are shaped apart from both the side wall of the steam generator and the water tubes in the tube bundle so that thermal communication with the liquid sodium in the heat transfer tubes is evenly established. The heat transfer tubes 14 discharge the liquid sodium into a mixing and distribution plenum 16. The plenum is formed by two wall members 18, 19 and the upper tube sheet 21 of the steam generator. The wall member 18 is cylindrical in shape and the wall member 19 is an annular plate that receives the open ends of the conduits 14. The plenum mixes the heating fluis so that there is substantially no variation in temperature in the heating fluid after passing through the conduits.

After being mixed in the plenum 16, FIG. 1, the liquid sodium is redirected downward around the tube bundle 7 by the upper tube sheet 21. The sodium flows around the water tubes 23 and around the thermal conduits 14. Thus, at this point the liquid sodium is brought into thermal communication with the liquid sodium flowing in the conduits and the water flowing inside of the water tubes 23. The flow of sodium around the water tubes is redistributed at frequent intervals by a plurality of baffles 25 of known construction. The sodium thereafter passes out of the steam generator through an outlet 27. The outlet is connected to the cold leg of a fast breeder reactor primary loop (not shown).

The manifold 12, the heat transfer conduits 14, and the mixing plenum 16 form a pre-cooling heat exchanger. The heat exchanger brings the liquid sodium coming directly from the hot leg of the primary loop into thermal communication with the relatively cooler liquid sodium circulating in the steam generator so that the temperature of the sodium is reduced prior to thermal communication with the water flowing in the water tubes 23.

Referring to FIG. 1, feed water enters the steam generator through a feed water inlet 30 located in the lower portion of the steam drum 8. The water in the steam generator is continuously circulated through the water tubes 23 by a recirculating pump 34. The recirculating pump takes suction on the lower portion of the steam drum and discharges into the lower mixing chamber 32 of the steam generator. The lower mixing chamber is formed by the bottom wall of the steam generator and the lower tube sheet 22. The recirculating pump is of known construction and maintains a constant flow of water through the water tubes so that the heat transferred from the liquid sodium in the steam generator is continuously transferred up into the steam drum.

The steam generator, FIG. 1, makes steam in the steam drum in the conventional manner. It should be appreciated that the steam generator is illustrated in FIG. 1 without moisture separators and without a water level controlling apparatus. These components are of known construction and form no part of the invention. In the preferred embodiment the steam generator makes saturated steam which passes out of the generator through a steam outlet 36.

In operation, hot liquid sodium enters the steam generator through the inlet 10 and is distributed to the heat transfer conduits 14 by the manifold 12. The sodium thereafter flows upward through the conduits and is cooled by the sodium flowing in the shell of the steam generator. The liquid sodium next enters the mixing plenum 16 and is deflected downward by the upper tube sheet 21. The liquid sodium passes downward around both the water tubes 23 and the conduits 14. The liquid sodium in the shell heats the water in the water tubes while lowering the temperature of the incoming sodium to the steam generator. The flow of sodium in the shell is redirected at various intervals by a series of baffles 25. The sodium passes out of the steam generator through the outlet 27 and returns to the cold leg (not shown) of the primary loop.

The thermal conduits 14 form an integral pre-cooling heat exchanger within the steam generator. These conduits bring the sodium coming directly from the hot leg of the primary loop into thermal communication with relatively cooler sodium circulating in the shell of the steam generator. This thermal communication reduces the temperature of the sodium prior to its coming into thermal communication with the water flowing in the water tubes 23. By pre-cooling the incoming sodium using sodium already circulating in the steam generator, the water flowing in the water tubes 23 is prevented from departing from nucleate boiling. Locating the pre-cooling heat exchanger in the steam generator and using internal sodium circulation permits the heat given up by the incoming sodium to be transferred to the water for generating steam without substantial loss.

It should be noted that the liquid sodium flows upward through conduits 14 and downward through the shell of the steam generator. Thus, the pre-cooling heat exchanger is a counter-flow type heat exchanger. The hot sodium coming from the hot leg of the primary loop initially communicates with the relatively cooler sodium located in the lower portion of the shell near the lower tube sheet 22. After the incoming sodium has cooled to some degree by flowing through the conduits 14, the relatively cooler sodium in the conduits communicates with the liquid sodium in the upper portion of the shell near the upper tube sheet 21. By this construction the temperature of the liquid sodium is lowered as much as possible while retaining the available heat for generating steam.

The steam generator makes steam in the steam drum 8 in the conventional manner. Make-up water enters the steam generator through the inlet 30. The recirculating pump 34 continuously circulates water through the water tubes 23 between the steam drum 8 and the lower mixing chamber 32. Steam is formed in the upper portion of the steam drum 8 and is withdrawn through the steam outlet 36. The water in the water tubes does not depart from nucleate boiling because the temperature of the primary coolant heating the water tubes has been substantially lowered by the pre-cooling heat exchanger. In addition, the recirculating pump 34 maintains a high rate of water flow through the water tubes.

Although the present invention has been described in connection with a fast breeder reactor and a steam generator for making saturated steam, the present invention also has application in other nuclear reactors where preventing DNB in the steam generator water tubes is a design criterion.

Thus, although the best mode for carrying out the present invention has been herein shown and described, it will be apparent that modification and variation may be made without departing from what is regarded as the subject matter of the invention.

What is claimed is:

1. A heat exchanger apparatus, comprising:

(a) a plurality of heat transfer tubes adapted for conveying a first fluid;

(b) a shell surrounding the heat transfer tubes and adapted for circulating a second fluid about the tubes so that the first and second fluids can be brought into thermal communication;

(c) an inlet nozzle to the heat exchanging apparatus for the second fluid;

(d) a distribution manifold for the second fluid connected to the inlet nozzle and located within the shell; and (e) a plurality of heat transfer conduits connected to the distribution manifold and located within the shell for conveying the second fluid, said heat transfer conduits being adapted for bringing the second fluid therein into thermal communication with the second fluid in the shell prior to the second fluid being circulated within the shell.

2. An apparatus as in claim 1 in which the heat transfer tubes are located in a tube bundle and the heat transfer conduits are co-axial with the heat transfer tubes and are disposed around the periphery of the tube bundle, the second fluid being conveyed to the peripheral conduits by distribution manifold located within the shell.

3. An apparatus as in claim 1 including a mixing plenum located in the heat exchanging apparatus and at the outlets of the heat transfer conduits for mixing the second fluid after passage through the conduits and prior to being circulated within the shell and in which the heat transfer conduits and the shell are disposed in counter-flow relationship so that the second fluid passes through both in counter-current flow.

4. An apparatus as in claim 1 in which the first fluid is the heated fluid and the second fluid is the heating fluid and in which the heat transfer conduits form a pre-cooling heat exchanger within the heat exchanging apparatus for reducing the temperature of the heating fluid prior to thermal communication with the heated fluid, the heat in the heating fluid being transferred in the conduits to the heating fluid circulating in the shell.

5. A steam generating apparatus for a nuclear reactor, comprising:

(a) a plurality of heat transfer tubes adapted for conveying water to a steam drum;

(b) a shell surrounding the heat transfer tubes and adapted for circulating reactor coolant about the tubes so that the water is heated therein and steam is generated in the steam drum;

(c) an inlet nozzle to the steam generating apparatus for the reactor coolant;

(d) a distribution manifold for the reactor coolant connected to the inlet nozzle and located within the shell; and (e) a plurality of heat transfer conduits connected to the distribution manifold and located within the shell for conveying the reactor coolant, said heat transfer conduits being adapted for bringing the primary coolant therein into thermal communication with the primary coolant in the shell prior to the primary coolant being circulated within the shell.

6. An apparatus as in claim 5 in which the reactor coolant is liquid sodium and the heat transfer conduits form a pre-cooling heat exchanger for reducing the temperature of the liquid sodium prior to thermal communication with the water circulating in the heat transfer tubes, the heat in the liquid sodium being transferred in the pre-cooling heat exchanger to the liquid sodium circulating in the shell so that the water is prevented from departing from nucleate boiling in the heat transfer tubes.

7. An apparatus as in claim 5 in which feed water is added to the steam drum of the steam generating apparatus and including a pump connected between the steam drum and the inlets to the heat transfer tubes for continously circulating the water through the heat transfer tubes and the steam drum during operation in a closed loop.

8. A method for transferring heat from a heating fluid to a heated fluid, comprising the steps of:

(a) directing a flow of heating fluid through a plurality of heat transfer conduits forming a first heat exchanger, said conduits being located within a second heat exchanger;

(b) mixing the heating fluid in a plenum after flow through the heat transfer conduits to avoid temperature variation;

(c) circulating the heating fluid within the second heat exchanger after mixing in the plenum;

(d) pre-cooling the heating fluid in the first heat exchanger prior to its circulation in the second heat exchanger using the heating fluid circulating in the second heat exchanger; and (e) transferring heat after pre-cooling from the heating fluid to the heated fluid.

9. A method as in claim 8 further including the steps of:

(a) reducing the temperature of the heating fluid using the first heat exchanger and the mixing plenum prior to transferring heat from the heating fluid to the heated fluid in the second heat exchanger; and (b) preventing the heated fluid in the second heat exchanger from departing from nucleate boiling by said pre-cooling.

* * * * *